US008091311B2

(12) United States Patent
Akagi et al.

(10) Patent No.: US 8,091,311 B2
(45) Date of Patent: Jan. 10, 2012

(54) COMPOSITE INTEGRATED MODULE AND METHOD FOR CONSTRUCTING A BUILDING

(75) Inventors: Kenji Akagi, Hitachi (JP); Shinji Asakura, Hitachi (JP); Susumu Futamura, Tokyo (JP); Kouji Yashima, Nishitokyo (JP); Yuuji Yasuda, Toda (JP)

(73) Assignees: Hitachi, Ltd., Tokyo (JP); Hitachi Plant Technologies, Ltd., Tokyo (JP)

( * ) Notice: Subject to any disclaimer, the term of this patent is extended or adjusted under 35 U.S.C. 154(b) by 182 days.

(21) Appl. No.: 11/829,116

(22) Filed: Jul. 27, 2007

(65) Prior Publication Data

US 2008/0022606 A1 Jan. 31, 2008

(30) Foreign Application Priority Data

Jul. 27, 2006 (JP) ..... 2006-204602

(51) Int. Cl.
*E04B 2/00* (2006.01)

(52) U.S. Cl. ..... 52/425; 52/295; 52/125.5; 52/27; 52/319; 52/742.14; 52/745.19

(58) Field of Classification Search ..... 52/295, 52/293.3, 424, 236.5, 432, 431, 425, 125.5, 52/125.3, 294, 296, 297, 27, 319, 327, 742.14, 52/745.15, 745.19; 60/644.1
See application file for complete search history.

(56) References Cited

U.S. PATENT DOCUMENTS 1,940,545 A * 12/1933 Holmes ..... 52/699
2,165,686 A * 7/1939 Suiter et al. ..... 52/236.6
2,192,182 A * 3/1940 Deutsch ..... 52/127.12
2,205,545 A * 6/1940 Schmitt ..... 52/27
2,794,336 A * 6/1957 Ballou ..... 52/705
3,225,562 A * 12/1965 Kramer ..... 62/263
3,315,424 A * 4/1967 Smith ..... 52/206
3,431,012 A * 3/1969 Eriksson et al. ..... 294/89

(Continued)

FOREIGN PATENT DOCUMENTS

JP 59-154266 9/1984

(Continued)

OTHER PUBLICATIONS

Japanese Office Action dated Oct. 5, 2011 in Application No. JP 2006-204602.

*Primary Examiner* — Robert Canfield
*Assistant Examiner* — Babajide Demuren
(74) *Attorney, Agent, or Firm* — Antonelli, Terry, Stout & Kraus, LLP.

(57) ABSTRACT

A composite integrated module may be used in a method for constructing a building. The module includes at least a floor member, and can also include a sidewall members installed on the floor member, and a ceiling member installed on the sidewall members. The floor member, sidewall members, and ceiling member can be connected to each other form an internal space. The floor member, sidewall members, and ceiling member have a formwork facing the internal space. Anchor members are mounted on the outer side of at least one of the formworks so as not to project into the internal space. A structure may be disposed in the internal space and mounted to the formwork with the anchor members by connecting removable tightening apparatuses to the anchor members from the internal space.

23 Claims, 5 Drawing Sheets

U.S. PATENT DOCUMENTS

| | | | | |
|---|---|---|---|---|
| 3,561,307 | A * | 2/1971 | Mortensen | 411/432 |
| 3,590,538 | A * | 7/1971 | Holt | 52/127.3 |
| 4,084,362 | A * | 4/1978 | Piazza | 52/309.2 |
| 4,084,780 | A * | 4/1978 | Mess | 249/59 |
| 4,164,151 | A * | 8/1979 | Nolan et al. | 73/663 |
| 4,211,048 | A * | 7/1980 | Naka | 52/700 |
| 4,637,928 | A * | 1/1987 | Zajac et al. | 423/659 |
| 4,706,424 | A * | 11/1987 | Garapick et al. | 52/181 |
| 5,199,289 | A * | 4/1993 | Hinson | 72/457 |
| 5,263,061 | A * | 11/1993 | Lamuro et al. | 376/260 |
| 5,346,415 | A * | 9/1994 | Waymon et al. | 440/7 |
| 5,379,563 | A * | 1/1995 | Tinsley | 52/295 |
| 5,402,734 | A * | 4/1995 | Galpin et al. | 108/28 |
| 5,484,522 | A * | 1/1996 | Entrekin | 210/86 |
| 5,491,944 | A * | 2/1996 | Mors et al. | 52/295 |
| 5,505,033 | A * | 4/1996 | Matsuo et al. | 52/296 |
| 5,558,920 | A * | 9/1996 | Heide | 428/116 |
| 5,771,093 | A * | 6/1998 | Tinti et al. | 356/244 |
| 5,809,702 | A * | 9/1998 | Matsuura et al. | 52/125.2 |
| 6,134,850 | A * | 10/2000 | Hui et al. | 52/167.1 |
| 6,256,960 | B1 * | 7/2001 | Babcock et al. | 52/592.1 |
| 6,494,639 | B1 * | 12/2002 | Friend | 403/403 |
| 6,840,022 | B1 * | 1/2005 | Manogue et al. | 52/745.2 |
| 6,893,199 | B2 * | 5/2005 | Michels | 411/340 |
| 6,925,761 | B1 * | 8/2005 | De La Marche | 52/79.7 |
| 7,441,743 | B2 * | 10/2008 | Behlinger et al. | 248/679 |
| 2001/0032435 | A1 * | 10/2001 | Austin | 52/749.12 |
| 2002/0189173 | A1 * | 12/2002 | Staschik | 52/79.1 |
| 2003/0009964 | A1 * | 1/2003 | Trarup et al. | 52/295 |
| 2006/0080897 | A1 * | 4/2006 | O'Neal | 52/1 |
| 2006/0080936 | A1 * | 4/2006 | Dooley et al. | 52/745.21 |
| 2006/0260232 | A1 * | 11/2006 | Crawford et al. | 52/295 |
| 2007/0044392 | A1 * | 3/2007 | LeBlang | 52/79.11 |

FOREIGN PATENT DOCUMENTS

| | | | |
|---|---|---|---|
| JP | 04-293864 | | 10/1992 |
| JP | 04293864 | A * | 10/1992 |
| JP | 05-107381 | | 4/1993 |
| JP | 05196777 | A * | 8/1993 |
| JP | 06-306869 | | 11/1994 |
| JP | 07-198885 | | 8/1995 |
| JP | 08086037 | A * | 4/1996 |
| JP | 10260284 | A * | 9/1997 |
| JP | 10-266602 | | 10/1998 |
| JP | 10-292668 | | 11/1998 |
| JP | 2003-013621 | | 1/2003 |
| JP | 2003-066177 | | 3/2003 |
| JP | 2003-167086 | | 6/2003 |
| JP | 2005-171628 | | 6/2005 |

* cited by examiner

COMPOSITE INTEGRATED MODULE AND METHOD FOR CONSTRUCTING A BUILDING

CLAIM OF PRIORITY

The present application claims priority from Japanese application serial no. 2006-204602, filed on Jul. 27, 2006, the content of which is hereby incorporated by reference into this application.

BACKGROUND OF THE INVENTION

The present invention relates to a composite integrated module and a method for constructing a building, and more particularly, to a composite integrated module and a method for constructing a building favorably applicable to construct a building of a nuclear power plant, for example, a reactor building.

In construction of a power plant, for example, a nuclear power plant, plant structures have been modularized in order to shorten the construction period of the plant.

Below will be explained examples of a construction of a nuclear power plant using the modularized structures.

Japanese Patent Laid-open No. Hei 4(1993)-293864 discloses a method for constructing a nuclear power plant building using building modules. This building module forms frameworks of floor section, a plurality of columns, and ceiling section with steel frames. Steel plates for floor, columns, and ceiling are attached to the inside of the frameworks. A building module is internally equipped with machine elements such as equipment, piping, trays, ducts, supports, and the like. A plurality of building modules are set out and concrete is poured between the modules and on their ceiling. The steel plates of the walls and the ceiling are used as formworks.

Modules disclosed by Japanese Patent Laid-open No. Hei 10(1998)-266602 forms a room for a nuclear power plant with two sidewall sections and a ceiling section placed on the sidewall sections. The sidewall section has steel plates and steel-frame columns and is attached the steel plates on a double side of the steel frame columns. The ceiling section comprises a Q-deck (or steel plate framework for ceiling) placed on a plurality of ceiling beams, reinforcing bars placed on the Q-deck, and piping and ducts on the ceiling beam. Concrete is poured between sidewall sections of adjacent modules, onto the Q-deck (or steel plate framework for ceiling), and between the steel plates of each sidewall section.

Japanese Patent Laid-open No. 2003-66177 discloses a room module of a hydraulic control unit (HCU) for a control rod drive system in a nuclear power plant. The module frame of the room module is formed with a plurality of steel frame structures disposed lengthwise and breadthwise. A plurality of module skids disposed lengthwise and breadthwise are mounted on the steel frame. Steel plate reinforcements being included in each sidewall section are mounted on the steel frame structures and the module skids. The room module has an HCU equipment, cable ducts, and piping. The room module is placed on a plurality of rotary extendable module receiving poles that can finely control the level of the room module. The steel plate reinforcements are used as formworks.

Japanese Patent Laid-open No. 2003-13621 discloses modules to be used for a power plant. This module comprises a frame having a plurality of steel columns and a plurality of steel beams. In the module, a Q-deck (or steel plate framework for ceiling) is placed on the upper part of the frame and piping and cable ducts are placed in the module. Reinforcing bars are installed around the steel beams and concrete is poured thereto for concrete walls.

SUMMARY OF THE INVENTION

Equipment being placed on the floor in the building of the power plant is installed on supporting structures that are buried in the floor. These supporting structures must be buried in the floor concrete when the concrete is poured. Therefore, to adopt a modular construction method for carrying integrated structural elements of a room into the plant building, it is difficult to assemble the supporting structures in a module, in terms of establishing connection with the framework of the building.

It is necessary to consider the following items pertaining to joint of plant facilities to the plant building such as equipment and piping that require disassembly for maintenance and inspection after they are installed.

When equipment and structural elements of the power plant are installed on at least one of the floor and walls of the building, it is considered that fixing members as anchor bolts and the like are first buried in the building and then used to fix the equipment and the structural elements of the plant. However, in this installation method, it is very hard to align the bolt holes of the equipment and the structural elements of the power plant with the anchor bolts buried in the building since their accuracies of production are different. If the equipment and the structural elements of the plant are placed on the floor only, an available method comprises the steps of enclosing each anchor bolt on the building with a sleeve or like that, installing the equipment and structural elements of the plant by the anchor bolts, and pouring concrete or mortar in the space between the anchor bolt and the sleeve. However, when the equipment and structural elements are connected to the walls and concrete (or mortar) is poured horizontally, they will interfere with pouring of concrete (or mortar). Therefore, it is difficult to pour the concrete. In order to solve this problem, it become required to pour the concrete that becomes the building after the anchors in the wall were installed concurrently with the installation of the equipment and structural elements. However, when ordinary removable formworks are to be used, the equipment and the structural elements of the plant will interfere with the formworks to be installed and removed. This prevents connection of the equipment, formwork, and walls. Further, it is required to remove the equipment and structural elements from the building when they are inspected or exchanged. However, when the equipment and the structural element are installed on two or more surfaces of the floor and one or more walls by using the anchor bolts, they cannot be removed and remounted because the outstanding anchor bolts in two or more directions are used.

When the equipment and the structural elements of the plant which are installed on a concrete groundwork and supporting structures provided with the floor of the building are assembled into a module, it is necessary to place the steel module frame to support the equipment and the structural elements of the plant below the equipment and the structural elements. In this case, the concrete groundwork and the module frame interfere with each other and consequently, the module cannot be installed. When a steel groundwork in place of the concrete groundwork is placed on the steel module frame, the module frames are exposed from the building. This aggravates the accessibility. Further, the module frames form partitioned spaces on the floor. This will make the drainage of the floor worse. Particularly, this cannot assure good decontamination in a facility that handles radioactive substances such as a nuclear power plant in which radioactive drainage is generated.

A considerable method is to install anchor bolts on the floor and the walls of a module and use these anchor bolts and nuts to fasten the equipment and the structural elements of the plant onto the two surfaces of the floor and the wall as mentioned above. However, in this method it is impossible to insert anchor bolts that are provided on the floor and walls into the corresponding bolt holes of the equipment and the structural elements of the plant.

Modules disclosed in Japanese Patent Laid-open No. Hei 10(1998)-266602 and Japanese Patent Laid-open No. 2003-13621 are respectively equipped with sidewalls and a ceiling and place piping and ducts (or trays) therein. However, Their prior arts do not disclose to the installation of the equipment and the structural elements of the plant in the modules. Meanwhile, modules disclosed in Japanese Patent Laid-open No. Hei 4(1993)-293864 and Japanese Patent Laid-open No. 2003-66177 are respectively equipped with the equipment in addition to the structures described by Japanese Patent Laid-open No. Hei 10(1998)-266602 and Japanese Patent Laid-open No. 2003-13621. However, Japanese Patent Laid-open No. Hei 4(1993)-293864 and Japanese Patent Laid-open No. 2003-66177 do not refer to the concrete installation structure of the equipment.

An object of the present invention is to provide a composite integrated module and a method for constructing a building that facilitates installation of internal structures of the module.

The present invention to accomplish the above object is characterized in that a module provides to a floor member having a plurality of horizontally-extending frames, a formwork mounted on the frames and anchor members provided on the lower surfaces of the formwork, wherein the anchor members are connected with removable tightening apparatuses from the upper part of the formwork are provided on the lower surfaces of the formworks.

Since the anchor members are provided on the lower surface of the formwork the anchor members do not protrude through an upper surface of the formwork. Thus, the equipment can move along the upper surface of the formwork without being blocked by the anchor members that are to be connected with the tightening units in installation of the equipment. Therefore, the equipment can be installed in the module easily by using the anchor members and the tightening apparatuses.

The above object can also be accomplished by a module comprising a floor member, a plurality of sidewall members mounted on the floor member, and a ceiling member installed the sidewalls, wherein the floor member, the wall members, and the ceiling member form an internal space of the module, the floor member has a first formwork facing the internal space, the sidewall members respectively has a second formwork facing the internal space, the ceiling member has a third formwork facing the internal space, anchor members are mounted on outerside of at least one of the first, second, and third formworks, and structures disposed in the internal space of the module are mounted to the formwork with the anchor members by connected with removable tightening apparatuses from the internal space.

Since the anchor members are provided outside the formworks, internal structures can be moved in the internal space for installation without being collided with and blocked by the anchor members. Therefore, the internal structures can be easily installed in the module by using the anchor members and their tightening apparatus.

A module of the present invention is characterized by comprising a floor member, a plurality of sidewall members mounted on the floor member, and a ceiling member installed the sidewalls, wherein the floor member, the sidewall members, and the ceiling member form an internal space of the module, the floor member has a plurality of frame beams mounted lower end portion of the sidewall member and is buried in concrete, a groundwork having an upper end positioned above a surface of concrete poured on the frames is provided with the frame beam, and equipment arranged in the internal space is mounted on the groundwork.

Since the floor is equipped with a plurality of frames being buried in concrete and a groundwork is provided on the frame beams with the upper end of the groundwork projected above the surface of concrete that is poured above the frame beams, it is possible to easily form a concrete floor that is slanted to a specified direction by casting concrete after installing the module. Accordingly, the other invention can obtain good drainage and good decontamination.

In accordance with the present invention, structures to be disposed in the internal space of a module can be installed easily in the module.

DETAILED DESCRIPTION OF THE PREFERRED EMBODIMENTS

Figure 1:
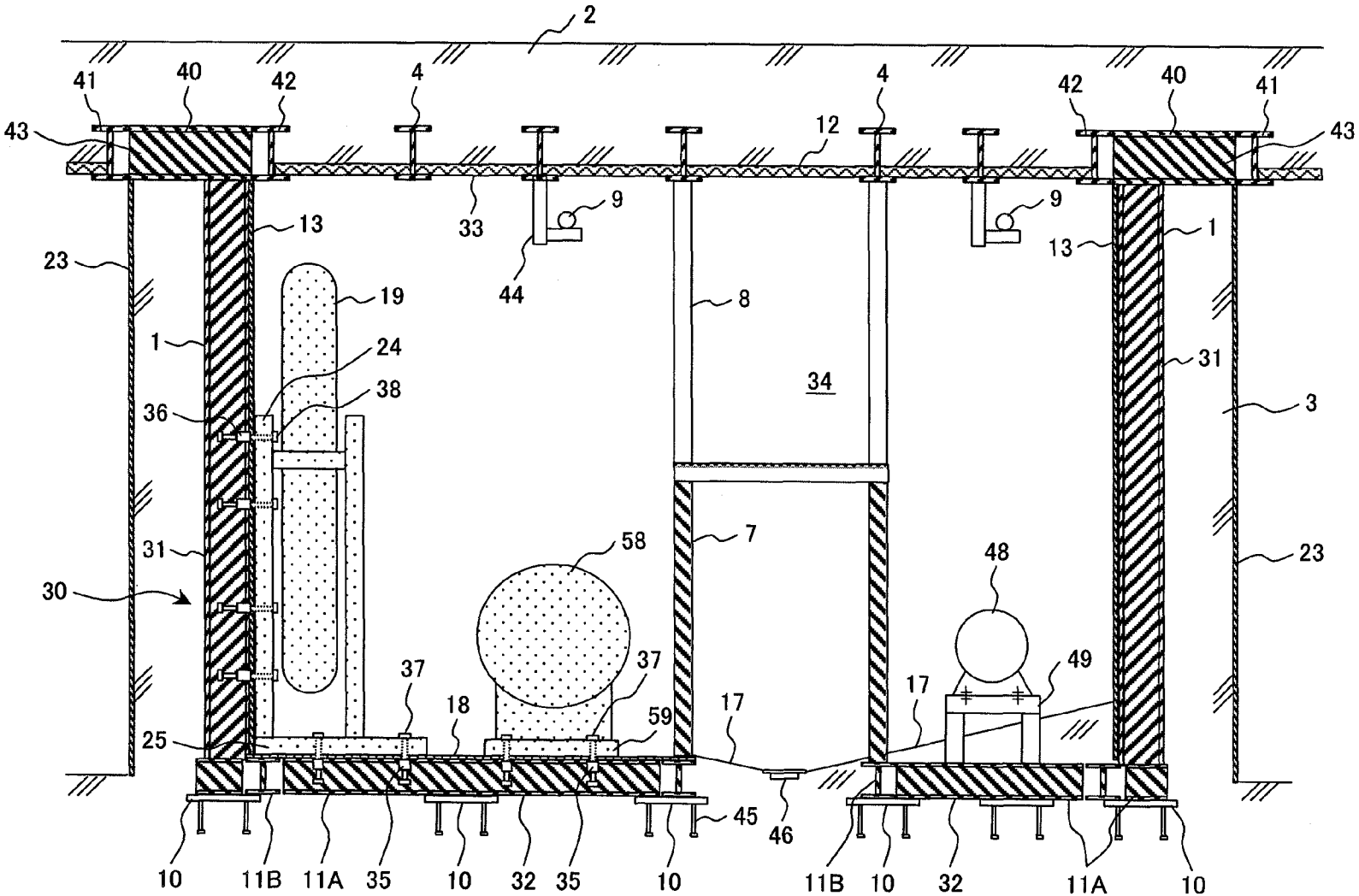
FIG. 1 is a structural diagram showing a module according to a preferred embodiment of the present invention.

Below will be explained embodiments of the present invention referring to drawings.

Embodiment 1

Referring to FIG. 1 to FIG. 6, below will be explained a module that is a preferable embodiment of the present invention and applicable to a building of a power plant, for example, to a reactor building of a nuclear power plant. The module 30 of the present embodiment is for a single room of the reactor building. The module 30 is provided with a plurality of sidewall members 31, the floor member 32, and the ceiling member 33. Four sidewall members 31 arranged on every side of the module 30 are connected each other. The floor member 32 is mounted on the lower end portion of the sidewall members 31. The ceiling member 33 is mounted on the upper end portion of the sidewall members 31. The module 30 has room 34 which is an internal space surrounded by the floor member 32, the ceiling member 33, and the sidewall members 31. At least one of the sidewall members 31 is provide with a door (not shown) through which a person can walk. The module 30 contains equipment 19 (e.g., tank and others) placed in room 34. The equipment 19 in the room 34 is an internal structure. The module 30 is a room module having the internal structures. The equipment 19 is provided with an installation frame 24 facing the sidewall members 31 and an installation frame 25 facing the floor member 32. The installation frame 24 is attached to the sidewall members 31 with installation bolts 38. Similarly, the installation frame 25 is attached to the floor member 32 with installation bolts 37. Components (e.g., frame beams and frame columns) respectively composing the sidewall members 31, the floor member 32, and the ceiling member 33 are made of steel.

The floor member 32 comprises a plurality of frame beams 11A, a plurality of frame beams 11B, a steel floor plate 18, and a plurality of anchor members 35. Each frame beam 11A is aligned in one direction and each frame beam 11B is aligned in another direction orthogonal to the one direction. The frame beams 11A and the frame beams 11B are welded together in this status to form a grid. The steel floor plate 18 is welded to the upper surfaces of frame beams 11A and 11B. The plurality of anchor members 35 are fixed in place on the back side of the steel floor plate 18. These anchor members 35 are perpendicular to the steel floor plate 18 and not projected to the inside of the room 34. As shown in FIG. 1, the central part of the floor member 32 has neither the frame beam 11A nor the frame beam 11B because the slanted floor 17 is formed here.

The sidewall member 31 is provided with a plurality of frame columns 1, steel wall plates 13, and a plurality of anchor members 36. The frame columns 1 are horizontally disposed at preset intervals. The steel wall plates 13 are mounted on the frame columns 1 on the inward side of the frame columns 1. The steel wall plate 13 faces the room 34 formed in the module 30. The plurality of anchor members 36 are fixed in place on the back side of the steel wall plates 13. The anchor members 36 are perpendicular to the steel wall plates 13 but not projected to the inside of the room 34.

The ceiling member 33 is provided with a plurality of frame beams 4, Q-deck 12, and frame beams 40. The frame beams 40 are disposed on four sides of the module 30 to form a rectangular ring. Each frame beam 40 includes beam members 41 and 42, and a plurality of beam members 43. The beam members 43 are arranged between beam members 41 and 42 and disposed in the longitudinal direction of beam members 41 and 42. Each end of beam member 43 is connected welded to beam member 41 and 42. Q-deck 12 can be replaced by a steel ceiling formwork.

Each frame beam 4 and Q-deck 12 are disposed in the rectangular ring being formed with four frame beams 40. The frame beams 4 are disposed in parallel along a predetermined direction. The Q-deck 12 is mounted on every frame beam 4. Both end portions of each frame beam 4 are respectively welded to the opposite two frame beams 40 (not shown in FIG. 1), specifically to internal beam members 42. One end portion of Q-deck 12 is mounted on respective beam members 42 of the two opposite frame beams 40 in FIG. 1.

The lower end portions of the frame columns 1 in four sidewall members 31 are respectively welded to one end portion of the frame beam 11A or 11B of the floor member 32. Each frame column 1 of two opposite sidewall members 31 is respectively welded to one end portion of respective frame beams 11A of the floor member 32. The number of the frame columns 1 of two sidewall members 31 that are provided is equal to the number of the frame beams 11A of the floor member 32. Each frame columns 1 of other two sidewall members 31 that are not shown in FIG. 1 are respectively welded to one end portion of the frame beams 11B of the floor member 32. The number of frame columns 1 of other two sidewall members 31 that are provided is equal to the number of the frame beams 11B of the floor member 32.

The upper end portion of the ceiling member 33 is mounted on four sidewall members 31. Respective beam members 43 in the ceiling member 33 are placed on the frame columns 1 of four sidewall members 31. The beam members 43 are separately welded to the frame columns 1. The upper end portion of the steel wall plate 13 of respective sidewall members 31 is welded to related frame beam 40, for example, respective beam members 43. It is possible to weld the steel wall plate 13 to the beam members 43.

The module 30 is provided with plant structures 9 such as piping, cable trays, and ducts and the like. The plant structures 9, for example, the piping to be connected to the equipment 19 are supported by supports 44 that are attached on the frame beam 4. Other internal structures are plant structures 9 disposed in the room 34.

Figure 2:
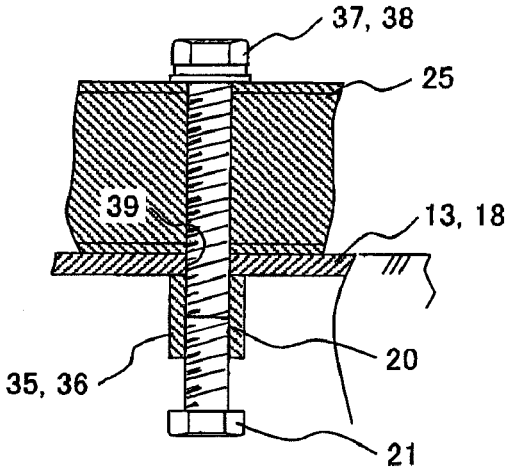
FIG. 2 is a detailed structural diagram showing an anchor member shown in FIG. 1.

Referring to FIG. 2, a detailed structure of the anchor members 35 and 36 will be explained using anchor member 35 as an example because the anchor members 35 and 36 are the same in structure. The anchor member 35 included a cylindrical connection member 20 and an anchor bolt 21. The connection members 20 are internally threaded. The anchor bolt 21 has a threaded portion to be engaged with the screw thread of the connection members 20. The anchor bolt 21 is screwed in into the connection member 20 from one end of the connection member 20. The anchor bolt 21 is screwed in as far as approximately half of the length of the connection member 20. In this status, the anchor bolt 21 is fastened to the connection member 20. Anchor member 35 with anchor bolt 21 fastened removably to the connection member 20 is fixed to a predetermined position on the back surface of the steel floor plate 18. In other words, the connection member 20 is mounted on the back surface of the steel floor plate 18 with the other end of the connection member 20 (the end which is not filled with anchor bolt 21) faced to the back side of the steel floor plate 18. Opening 39 is formed in the steel floor plate 18 at a point which is on the extension of the center line of the connection member 20. The opening 39 is provided for each anchor member 35 oppositely to the screw hole of the connection member 20. The anchor member 35 does not project above the steel floor plate 18 towards the inside of the room 34.

Anchor member 36 as well as the anchor member 35 comprises the connection member 20 and the anchor bolt 21. One end of the connection member 20 of the anchor member 36 is fixed to a predetermined position on the back surface of the steel wall plate 13. Opening 39 is formed in the steel wall plate 13 at a point which is on the extension of the center line of the connection member 20. The opening 39 of the steel wall plate 13 is provided for each anchor member 36 oppositely to the screw hole of the connection member 20.

In the above description, each of anchor members 35, 36 is an assembly of the connection member 20 and the anchor bolt 21. However, it is possible to use the anchor member as a single-component unit.

Figure 3:
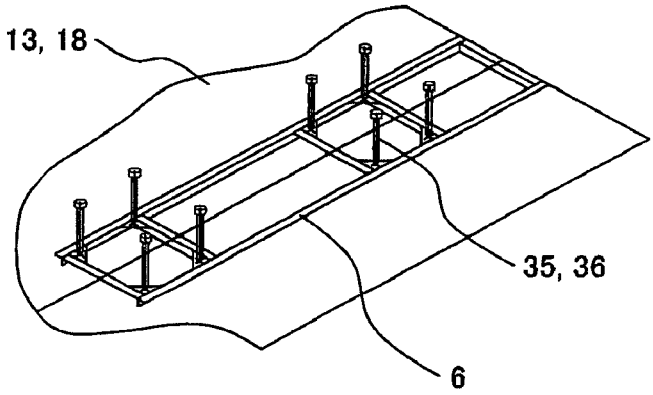
FIG. 3 is a explanatory drawing showing a method for mounting anchor members by using a positioning tool.

Referring to FIG. 3, a method to fix the anchor members 35, 36 on the steel floor plate 18 and the steel wall plate 13 will be explained using fixation of the anchor member 35 as an example. The position and number of the anchor members 35 are determined by the position and number of through holes, in which mounting bolts 37 are inserted, formed in the installation frame 25 on which the equipment 19 is placed. Positioning tool 6 shown in FIG. 3 is used to mount the anchor members 35 on the steel floor plate 18. The positioning tool 6 determines positions of the anchor members 35 whose number is determined by the position and number of the above-described through holes formed in the installation frame 25. The openings 39 as many as the through holes are formed in the steel floor plate 18. The positioning tool 6 that holds the predetermined number of the anchor members 35 is put in place on the back surface of the steel floor plate 18. The connection member 20 for each anchor member 35 held by the position tool 6 is fixed on the back surface of the steel floor plate 18. The use of the positioning tool 6 increases the accuracy of positioning the anchor members 35 and 36 onto the back surfaces of the steel floor plate 18 and the steel wall plate 13 and the accuracy of installation of the anchor members 35 and 36. The anchor members 35 are respectively fixed so as not to interfere with the frame beams 11A and 11B.

The position and number of the anchor members 36 are determined by the position and number of the through holes, in which mounting bolts 38 are inserted, formed in the installation frame 24 on which the equipment 19 is placed. The predetermined number of the anchor members 36 is fixed on the back surface of the steel wall plate 13 in sequence by using the positioning tool 6. The anchor members 36 are respectively fixed so as not to interfere with the other members when they are fixed.

The equipment 19 is installed on two surfaces of the module 30. As already explained, in the present embodiment, the equipment 19 is installed on the floor member 32 and one of the sidewall members 31. The equipment 19 is installed by the following procedure. The installation frame 25 placed the equipment 19 is put on the floor member 32 so as to align its through holes of the installation frame 25 over the openings 39 in the steel floor plate 18. Similarly, the through holes of frame 24 are aligned over the openings 39 of the steel wall plate 13. In this status, the predetermined number of mounting bolts (fastening apparatus) 37 are respectively inserted into the corresponding screw holes of the connection members 20 of the anchor members 35 through the corresponding through holes formed in the installation frame 25 and openings 39 in the steel floor plate 18. When the mounting bolt 37 is turned and the screw thread of the mounting bolt 37 is engaged with the screw thread of the connection member 20 of the anchor members 35, the installation frame 25 is removably fastened to the floor member 32. Similarly, the predetermined number of mounting bolts (fastening apparatus) 38 are respectively inserted into the corresponding screw holes of the connection members 20 of the anchor members 36 through the corresponding through holes formed in the installation frame 24 and the openings 39 in the steel wall plate 13. When the mounting bolt 37 is turned and the screw thread of the mounting bolt 37 is engaged with the screw thread of the coupling member 20 of the anchor members 36, the installation frame 24 is removably fastened to the sidewall member 31.

An equipment 58 is mounted on one surface of the module 30, that is, the floor member 32. The equipment 58 is fastened to the floor member 32 by engaging the mounting bolts 37 inserted in through holes formed in frame 59 with the anchor members 35 that are provided on the back surface of the steel floor plate 18 as well as the equipment 19.

Other equipment 48 (e.g., rotary apparatus) is mounted on the steel groundwork 49 placed on the frame beams 11A and 11B. It is necessary that the floor of the module 30 assures the drainage and decontamination of radioactive substances. For this purpose, in the present embodiment, the steel groundwork 49 is provided the steel groundwork 49 on the frame beams 11A and 11B buried in concrete and the equipment 48 is installed on the steel groundwork 49. When the slanted surface 17 is formed by the poured concrete over the frame beams 11A and 11B, it is so constructed that the upper end of the steel groundwork 49 is above the surface of the poured concrete. The steel floor plate 18 is not provided on the frame beams 11A and 11B on which the steel groundwork 49 is placed. In this case, a floor margin 50 to bury the frame beams 11A and 11B is formed.

The module 30 of the present embodiment is provided with the plurality of columns 8 for structures in the center part of the room 34. These columns 8 are mounted on the plurality of frame beams 4 of the ceiling member 33. The lower ends of each column 8 is supported by temporary columnar support 7 that is provided on the frame beam 11B of the floor member 32 so that the center of the ceiling member 33 is supported by the columns 8 and the temporary columnar supports 7. It is possible to substitute the temporary columnar supports 7 by extension of the columns 8 on the frame beam 11B.

Below will be explained a method for constructing a building with the module 30 provided with the equipments 19, 48, and 55 by using a reactor building as an example. The module 30 is assembled in a factory and transferred to the building construction field. If the module 30 is too big to be transferred from the factory to the construction field, it is possible to manufacture required parts in the factory and assemble the parts into the module 30 in the field of the nuclear power plant or, for example, near the construction field of the plant.

A plurality of embedded plates 10 each of which has a plurality of anchors 45 on back surface of the embedded plate 10 are buried in place beforehand in the field of the reactor building on which the module 30 is placed. The upper surface of embedded plate 10 is a little lower than the reference floor level (by the height of the frame beam 11A or 11B). Concrete is poured to the level of the upper surface of the embedded plate 10.

The module 30 is lifted by a crane with its the floor member 32 faced downward, transferred to the construction site of the reactor building, and placed on the plurality of embedded plates 10 buried in concrete. Burial margins of the frame beams 11A and 11B buried in concrete are assured by placing the module 30 on the embedded plates 10 that is in the above level. After concrete is poured to the upper surface level of the embedded plates 10 and hardened, the module 30 is placed on the embedded plates 10. Therefore, the weight of the module 30 is steadily transmitted to the floor of the reactor building. This structure can reduce the frame beams 11A and 11B and the weight of the floor member 32. This leads to reduction of weight of the module 30.

Reinforcing bars (not shown) are disposed above the ceiling member 33. Four wooden formworks 23 are provided oppositely to steel wall plates 13 outside the sidewall members 31 that are provided on four sides of the module 30. The wooden formworks 23 are not attached to the module 30. After the module 30 is placed on the predetermined position where the reactor building is constructed, the wooden formworks 23 are placed before concrete is poured. A clearance of a predetermined distance is provided between the steel wall plate 13 and the wooden formworks 23. Concrete is poured on the upper part of the ceiling member 33 and to the outside of the respective sidewall members 31. To pour concrete to the outside of the sidewall members 31, concrete is poured into the space between the steel wall plate 13 and the wooden formwork 23 through the space between the sidewall member 31 and the beam member 43. When concrete is poured on the floor, the frame beams 11A and 11B, the anchor members 35, the embedded plates 10, and the anchor members 45 are all buried in concrete. Similarly, the anchor members 36 fixed on the back surface of the steel wall plate 13 and the frame columns 1 are also buried in concrete poured between the steel wall plate 13 and the wooden formwork 23. Further a concrete layer of a predetermined thickness is poured above the Q-deck 12. The steel wall plates 13, the Q-deck 12, and the steel floor plate 18 are used as formworks for pouring concrete. When a steel formwork of the ceiling is used instead of the Q-deck 12, the steel formwork is used as a formwork for the ceiling. Item 2 indicates ceiling concrete and item 3 is wall concrete.

Slanted surface 17 of a concrete floor is formed in the center of the floor member 32 in the room 34. The slanted surface 17 is the lowest at the center and a drain collection pit 46 is formed there to collect drain.

In the above concrete pouring, concrete is also placed on the floor margin 50 which is on a place where the steel groundwork 49 is placed. With this, the frame beams 11A and 11B are poured in concrete. Further, the slanted surface 17 is formed above the floor member 32. Since the upper end portion of the steel groundwork 49 is raised as already explained, a concrete floor having the slanted surface 17 can be formed below the upper end portion of the steel groundwork 49 in the module 30.

After the poured concrete becomes solidified, the anchor members 35 have functions of anchoring the steel floor plate 18 and fastening the equipment 19 together with the mounting bolts 37. Similarly, anchor members 36 have functions of anchoring the steel wall plates 13 and fastening the equipment 19 together with the mounting bolts 38.

In the present embodiment, the anchor members 35 and the anchor members 36 are provided respectively on the back surface of the steel floor plate 18 and on the back surface of the steel wall plate 13 and the anchor members are not projected over the surface of each steel plate 18, 13. Thus, the present embodiment can easily install the internal structures that must be installed on at least two of the sidewall members 31, the floor member 32, and the ceiling member 33, specifically the equipment 19, into the module 30. It is possible to align the through holes, into which the mounting bolts 37 are inserted, formed in the installation frame 25 with the openings 39 formed in the steel floor plate 18 while moving the lower surface of the installation frame 25 of equipment 19 horizontally along the upper surface of the steel floor plate 18. If the through holes are not aligned with the openings 39 when the lower surface of the frame 25 touches the upper surface of the steel floor plate 18, it is possible to easily align the through holes with the openings 39 by moving equipment 19 horizontally while the lower surface of the frame 25 touches the upper surface of the steel floor plate 18. In this state, because it is possible to touch directly a side surface of the installation frame 24 to an inner surface of the steel wall plate 13, the through holes, into which the mounting bolts 38 are inserted, formed in the installation frame 24 can be easily aligned with the openings 30 formed in the installation 24. As already explained, the mounting bolts 37 are engaged with the connection members 20 of the anchor member 35 and similarly the mounting bolts 38 are engaged with the connection members 20 of the anchor member 36. Therefore, the equipment 19 can be easily installed on two surfaces of the module 30. In accordance with the present embodiment, it never happens that the equipment 19 is blocked by the anchor members 35 and 36 while moving to the installation site. Therefore, as explained above, the equipment 19 can be easily installed on two surfaces of the module 30.

The present embodiment can dissolve the aforementioned problems of installing plant equipment with anchor bolts and nuts, by providing anchor bolts on the floor member and wall members of the module.

To perform maintenance and inspection of the equipment 19 in the annual inspection of the nuclear power plant after the module 30 is installed, the mounting bolts 37 and 38 are removed from the floor member 32 and the sidewall member 31. Thus, the equipment 19 can transfer and the maintenance and the inspection of the equipment 19 can be easily carried out. Necessarily, after the maintenance and the inspection, the equipment 19 can be easily re-installed in the module 30 as already explained. The tightening forces of the mounting bolts 37 and 38 can be transmitted to concrete through the anchor members 35 and 36.

Unlike the equipment 19, the equipment 58 is installed on one surface (the floor member 32) in the module 30 with the anchor members 35 and the mounting bolts 37. Since the anchor members 35 are not projected above the steel floor plate 18, the equipment 58 can move without coming into collision with the anchor members 35 during moving the equipment 58 horizontally for installing on the steel floor plate 18 of the floor member 32. Further, the movement of the equipment 58 is not limited by the anchor members 35. In this way, the present embodiment can easily install the internal structures in the module 30 by using the anchor members 35 and the mounting bolts 37 even when the internal structure is mounted on a single inner surface of the module 30. By using the anchor members 35 provided on the back surface of one of the steel floor plate 18, the steel wall plate 13, and Q-deck 12, the internal structures can be installed easily and quickly on one surface (any one of sidewall members 31, the floor member 32, and the ceiling member 33 of the module 30.

It is possible to easily demount the equipment 58 from the floor member 32 by disengaging the mounting bolts 37 from their anchor members 35. So, the maintenance and the inspection of the equipment 58 can be easily carried out. After the maintenance and the inspection, the equipment 58 can be remounted on the floor member 32 easily as explained above.

Since the ceiling member 33 is supported by the frame columns 1 that are disposed under the ceiling member 33, the frame columns 1 can support the weight of concrete poured on the Q-deck 12 during pouring concrete. Therefore, this enables simultaneous the pouring of concrete on Q-deck plate 12 and the outside of the sidewall members 31 and shortens the construction period of a nuclear power plant. Particularly, the present embodiment can omit the period of aging wall concrete before concrete is poured on the ceiling section.

The present embodiment can greatly reduce the flexure of the frame beams 4 and the Q-deck 12 during pouring concrete on the Q-deck 12 because the center portion of the ceiling member 33 is supported by the columns 8 and the temporary columns 7. Therefore, the positions on which plant structures 9 are placed will not be affected by the pouring of concrete and the plant structures 9 can be always placed on the predetermined positions.

In this embodiment, because the lower surface of the frame beam 43 is high as the lower surface of the beam member 43, notches in the beam through holes can be omitted. Therefore, processes of notching the steel wall plates 13, and processes to treat the notches can be omitted too. Further, since the steel wall plates 13 are welded to the frame beams 40, the steel wall plates 13 are protected against deformation while the module 30 having four sidewall members 31 and the ceiling member 33 is hoisted up and transferred by a crane.

To support the reactive force of the equipment 48, for example, a rotary apparatus during operation, the steel groundwork 49 requires a structure to release the reactive force to the building of the reactor building via the frame beams 11A and 11B. To solve this problem, it is assumed to be possible to provide stud bolts on the frame beams 11A and 11B to fasten the equipment. However, it is necessary to prevent stud bolts from interfering with reinforcing bars placed on the floor. As the result, the floor margin 50 is forced to become greater and a lot of unwanted concrete is used. To prevent the increase of the floor margin 50, the present embodiment provides embedded plates 51 under the frame beams 11A and 11B just under the steel groundwork 49. The embedded plates 51 are welded (or bolted) to the frame beams 11A and 11B. Each embedded plate 51 is fixed with a plurality of anchors 52 on the lower surface thereof. The embedded plates 51 and the anchors 52 are buried in concrete. With the above construction, the present embodiment enables transmission of the reactive force of the operating rotary apparatus on the steel groundwork 49 to the building and assures the required strength of the rotary apparatus to the foundation structure. Further, the use of the embedded plates 51 enables installation of shim materials for module level adjustment between the embedded plates 51 and the frame beams 11A and 11B. In other words, the adjustment of the installation level of the module 30 is made easier.

For installation of a rotary apparatus and other equipment that require high rigidity for the steel groundwork 49, it is possible to assure the rigidity of the foundation by the steel groundwork 49 and the frame beams 11A and 11B and increase the rigidity as high as that of a conventional concrete groundwork by filling steel groundwork 49 with concrete (or mortar) after installing the module 30 on the predetermined installation site of the reactor building.

Since the present embodiment can form a slanted concrete surface 17 towards the upper part of the floor member 32 by the pouring of concrete, drain liquid can be easily collected into the drain recovery pit 46. Further, also when a decontamination work is carried out on the internal structures (for example, piping 53A shown in FIG. 7 to be explained later) in the module 30, the generated waste water can be collected into the drain recovery bit 46.

Figure 7:
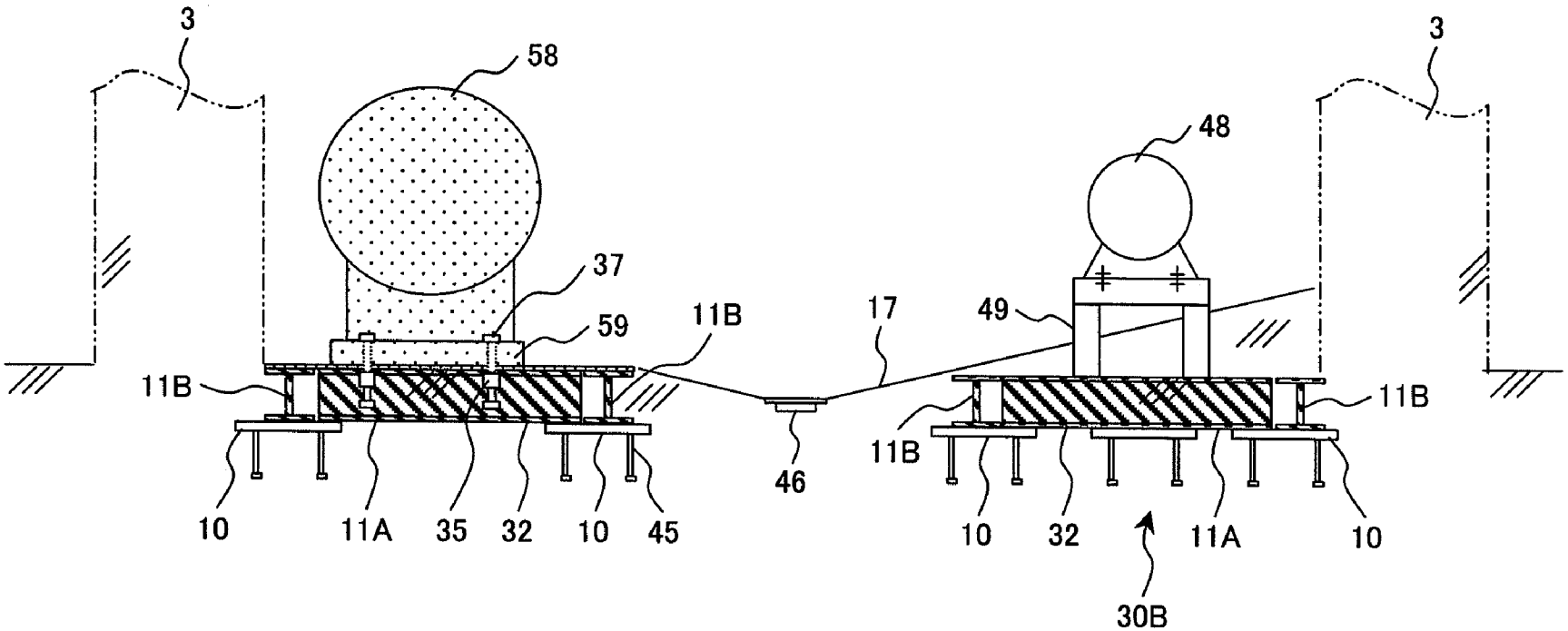
FIG. 7 is a structural drawing showing a module of Embodiment 2 according to another embodiment of the present invention.

As explained above, when the equipment 48 is installed using the steel groundwork 49, supports (or stands) 54A, 54B, and 54C to support pipes 53A, 53B, and 53C around the equipment 48 are mounted on the frame beams 11B (or 11A) that are buried in concrete (see FIG. 7). However, when the operational reactive force of the equipment 48 is great and the strength of frame beam 11B is not enough for it, support 54B is provided on the embedded plate 55 that is welded to the upper surface of the frame beam 11B. The embedded plate 55 is provided with anchors 56. If the embedded plate 55 is buried in concrete that is below the slanted surface 17 of the floor, embedded plate supporting member 57 is provided on the upper surface of the frame beams 11B (see 54C of FIG. 6). The embedded plate 55 is mounted on the embedded plate supporting member 57 and the support 54C is mounted on this embedded plate 55. The use of the embedded plate 55 and the embedded plate supporting member 57 can assure the floor strength that is required during operation of the equipment 48 and improve the workability of the building floor.

Although the module 30 in the above embodiment is applied to a reactor building, the module 30 is also applicable to a turbine building and a radioactive waste building in the nuclear power plant. Further, the module 30 can be applied to building of a thermal power plant.

Embodiment 2

Figure 4:
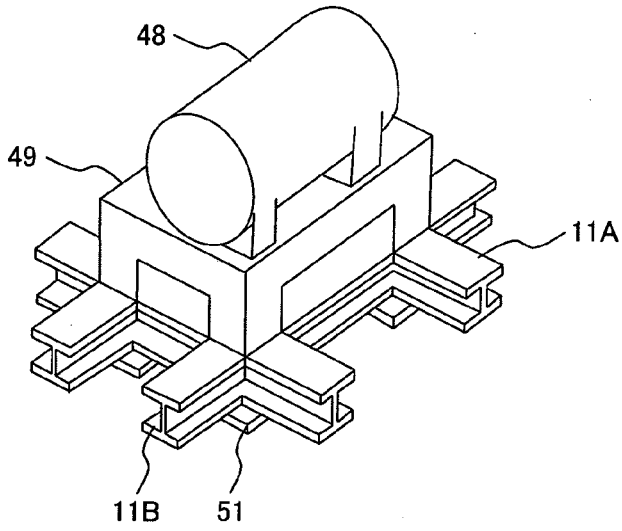
FIG. 4 is an oblique perspective view showing installed equipment 48 shown in FIG. 1.
Figure 5:
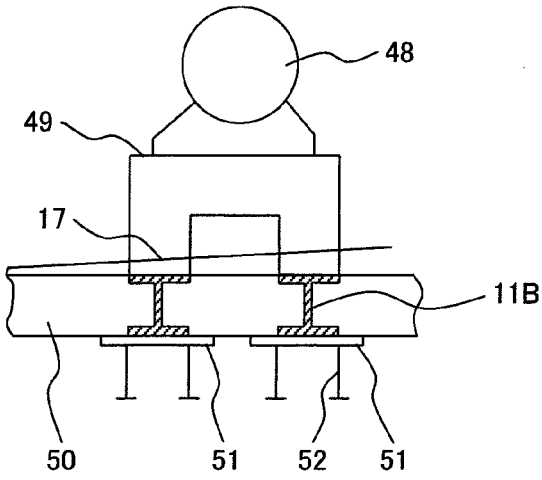
FIG. 5 is a front view showing installed equipment 48 shown in FIG. 1.
Figure 6:
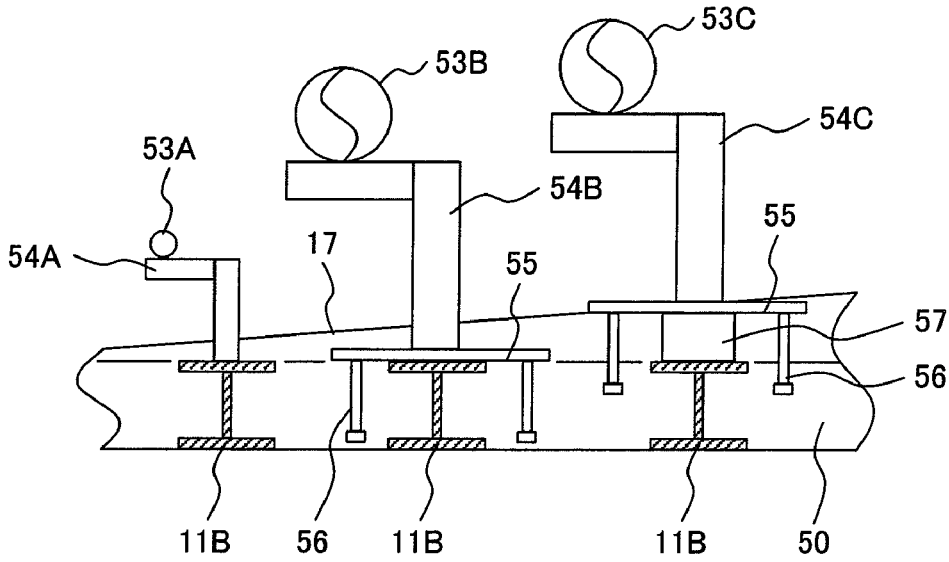
FIG. 6 is a structural drawing showing installed piping placed around equipment 48 shown in FIG. 1.

A module which is another embodiment of the present invention will be explained below referring to FIG. 7. Module 30B of Embodiment 2 uses the floor member 32 of the module 30 of Embodiment 1 and installs the equipment 58 and the equipment 48 (for example a rotary apparatus) on the floor. The module 30B is not provided with the sidewall members 31 and the ceiling member 33 of the module 30. As shown in FIG. 4 and FIG. 5, the equipment 48 is installed on the steel groundwork 49 placed on the frame beams 11A and 11B. Also in the module 30B, the anchor members 35 that are used in the module 30 are provided on the back surface of the steel floor plate 18 of the floor member 32. The equipment 58 is fixed to the floor member 32 by engaging the mounting bolts 37, each of which is inserted into through holes formed in the frame 59, with the anchor members 35 provided on the back surface of the steel floor plate 18. Similarly to Embodiment 1, the floor member 32 is not provided with the frame beams 11A and 11B in the center of the floor since slanted surface 17 of the floor is formed there.

The module 30B like the module 30 is also placed on a plurality of the embedded plates 10 buried in a predetermined construction site of the reactor building. A room is formed in the upper part of the module 30B. Therefore, wooden formworks for side walls and the ceiling of the room are provided before the pouring of concrete. As for the side walls, two wooden formworks are placed face to face and reinforcing bars are provided between these wooden formworks. The wooden formwork of the ceiling is supported by a plurality of supporting members. In this status, concrete is poured on the upper part of the wooden formwork of the ceiling and between two wooden formworks of the side wall. The anchor members 35 are buried in concrete. The slanted surface 17 that inclines to a drain recovery pit 46 is formed in the center of the floor member 32 of the module too. Similarly to Embodiment 1, the present embodiment forms the slanted surface 17 above the frame beams 11A and 11B in the place where the steel groundwork 49 is placed.

The present embodiment like Embodiment 1 facilitates installation of the equipment (structures) 55 since the anchor members 35 and the mounting bolts 37 are used to install the equipment 58. Further, since the present embodiment places the steel groundwork 49 on the frame beams 11A and 11B similarly to Embodiment 1 with its upper end portion above the surface (the slanted surface 17) of concrete that covers the frame beams 11A and 11B, the slanted surface 17 can be formed above the floor member 32.

It is possible to place a module without the equipment 48 and 55, specifically a module having a steel groundwork 49 on the floor member 32 or a module having a floor member 32 without the steel groundwork 49 on the plurality of the embedded plates 10 that are buried in the predetermined construction site of the reactor building before the pouring of concrete. In this case, the equipment and other structures are installed by using the anchor members 35 of the floor member 32 or the steel groundwork 49 after concrete is solidified. Embodiment 2 like Embodiment 1 facilitates installation of the equipment 55 also when the equipment is secured by the anchor members 35 and the mounting bolts 37 after the pouring of concrete.

What is claimed is:

1. A composite integrated module, comprising:

a floor member having a plurality of frames extending in horizontal direction and a steel formwork placed on said plurality of frames; and a plurality of anchor members engageable with removable tightening apparatuses from above said steel formwork, provided on a lower surface of said steel formwork so as not to project above said steel formwork;

wherein each of said anchor members comprises a longitudinally extending connection member having a longitudinal axis perpendicular to said steel formwork, a first end of said connection member being fixed to said lower surface of the steel formwork and having an internally threaded hole extending along the longitudinal axis from said first end, and an anchor portion engaged with a part of said internally threaded hole formed in said connection member and extending along the longitudinal axis from a second end, opposite said first end;

wherein said steel formwork has an opening therethrough, adjacent to which said internally threaded hole of said connection member is provided, and wherein said removable tightening apparatuses are inserted from above said steel formwork through said opening and are fixed in a remainder of said internally threaded hole of said connection member.

2. The composite integrated module according to claim 1, further comprising equipment placed on an upper surface of said steel formwork and installed on said floor member with tightening apparatuses engaged with said anchor members.

3. The composite integrated module according to claim 2, wherein a groundwork having an upper end positioned above a surface of concrete poured on said frames is provided on said frame and other equipment is mounted on said groundwork.

4. The composite integrated module according to claim 1, wherein said internally threaded hole extends through said connection member from said first end to said second end, and wherein said anchor portion includes an external threaded portion fixed in said internally threaded hole of said connection member.

5. A composite integrated module, comprising:

a floor member, a plurality of sidewall members installed on said floor member, and a ceiling member installed on sidewall member;

wherein said floor member, said sidewall members, and said ceiling member are connected to each other form an internal space, said floor member has a first steel formwork facing said internal space, each of said sidewall members respectively has a second steel formwork facing said internal space, the ceiling member has a third steel formwork facing said internal space, anchor members are mounted on the outer side of at least one of said first steel formwork, said second steel formwork and said third steel formwork so as not to project into said internal space, and a structure disposed in said internal space mounted to said at least one of said first steel formwork, said second steel formwork and said third steel formwork with said anchor members by connecting removable tightening apparatuses to said anchor members from said internal space;

wherein each of said anchor members comprises a longitudinally extending connection member having a longitudinal axis perpendicular to said at least one of said first steel formwork, said second steel formwork and said third steel formwork, a first end of said connection member being fixed to said outer side of said at least one of said first steel formwork, said second steel formwork and said third steel formwork, and having an internally threaded hole extending along the longitudinal axis from said first end, and an anchor portion engaged with a part of said internally threaded hole formed in said connection member and extending along the longitudinal axis from a second end, opposite said first end; and wherein said at least one of said first steel formwork, said second steel formwork and said third steel formwork has an opening therethrough, adjacent to which said internally threaded hole of said connection member is provided, and wherein said removable tightening apparatuses are inserted from said internal space through said opening and are fixed in a remainder of said internally threaded hole of said connection member.

6. The composite integrated module according to claim 5, wherein said floor member has first frame beam mounted outside said first steel formwork, said sidewall members have a plurality of frame columns mounted outside said second steel formwork, a lower end portion of each frame column is mounted on said first frame beam, and an upper end portion of each frame column is mounted to said ceiling member.

7. The composite integrated module according to claim 6, wherein said ceiling member has second frame beams including an opening through which concrete is poured, said third steel formwork is mounted on said second frame beam, and said second frame beam is connected to an upper end portion of said frame column.

8. The composite integrated module according to claim 7, wherein an upper end portion of said second steel formwork is mounted on said second frame beam.

9. The composite integrated module according to claim 5, wherein said internally threaded hole extends through said connection member from said first end to said second end, and wherein said anchor portion includes an external threaded portion fixed in said internally threaded hole of said connection member.

10. , A composite integrated module, comprising:

a floor member, a plurality of sidewall members installed on said floor member, and a ceiling member installed on said sidewall members;

wherein said floor member, said sidewall members, and said ceiling member are connected to each other form an internal space, said floor member has a first steel formwork facing said internal space, and a plurality of frame beams mounted on an undersurface of said first steel formwork, mounted on lower end portions of said sidewall members, and buried in concrete, said sidewall members respectively have with a second steel formwork facing said internal space, said ceiling member has a third steel formwork facing said internal space, anchor members are mounted on an outer side of at least one of said first steel formwork, said second steel formwork and said third steel formwork so as not to project into said internal space, a structure disposed in said internal space mounted to said at least one of said first steel formwork, said second steel formwork and said third steel formwork with said anchor members by connecting removable tightening apparatuses to said anchor members from said internal space, a groundwork having an upper end positioned above a surface of concrete poured on said frames is provided on said frame, and other equipment arranged in said internal space is mounted on said groundwork;

wherein each of said anchor members comprises a longitudinally extending connection member having a longitudinal axis perpendicular to said at least one of said first steel formwork, said second steel formwork and said third steel formwork, a first end of said connection member being fixed to said outer side of said at least one of said first steel formwork, said second steel formwork and said third steel formwork, and having an internally threaded hole extending along the longitudinal axis from said first end, and an anchor portion engaged with a part of said internally threaded hole formed in said connection member and extending along the longitudinal axis from a second end, opposite said first end; and wherein said at least one of said first steel formwork, said second steel formwork and said third steel formwork has an opening therethrough, adjacent to which said internally threaded hole of said connection member is provided, and wherein said removable tightening apparatuses are inserted from said internal space through said opening and are fixed in a remainder of said internally threaded hole of said connection member.

11. The composite integrated module according to claim 10, wherein said internally threaded hole extends through said connection member from said first end to said second end, and wherein said anchor portion includes an external threaded portion fixed in said internally threaded hole of said connection member.

12. A method for constructing a building, comprising the steps of:

transferring a composite integrated module comprising a floor member having a plurality of frames extending in horizontal direction and a steel formwork placed on said frame, and anchor members engageable with removable tightening apparatuses from above said steel formwork, provided on a lower surface of said steel formwork so as not to project above said steel formwork;

placing said composite integrated module on a predetermined construction site of the building;

pouring concrete below said steel formwork of said placed composite integrated module, and installing and fastening equipment onto said floor member with removable tightening apparatuses engaged with said anchor members from above said steel formwork;

wherein each of said anchor members comprises a longitudinally extending connection member having a longitudinal axis perpendicular to said steel formwork, a first end of said connection member being fixed to said lower surface of the steel formwork and having an internally threaded hole extending along the longitudinal axis from said first end, and an anchor portion engaged with a part of said internally threaded hole formed in said connection member and extending along the longitudinal axis from a second end, opposite said first end; and wherein said steel formwork has an opening therethrough, adjacent to which said internally threaded hole of said connection member is provided, and wherein said removable tightening apparatuses are inserted from above said steel formwork through said opening and are fixed in a remainder of said internally threaded hole of said connection member.

13. The method for constructing a building according to claim 12, wherein said internally threaded hole extends through said connection member from said first end to said second end, and wherein said anchor portion includes an external threaded portion fixed in said internally threaded hole of said connection member.

14. A method for constructing a building, comprising the steps of:

transferring a composite integrated module comprising a floor member having a plurality of frames extending in horizontal direction and a steel formwork placed on said plurality of frames, and anchor members engageable with removable tightening apparatuses from above said steel formwork provided on a lower surface of said steel formwork so as not to project above said steel formwork, and equipment placed on an upper surface of said steel formwork installed on said floor member with tightening apparatuses;

placing said composite integrated module on a predetermined construction site of the building; and pouring concrete below said steel formwork of said placed composite integrated module;

wherein each of said anchor members comprises a longitudinally extending connection member having a longitudinal axis perpendicular to said steel formwork, a first end of said connection member being fixed to said lower surface of the steel formwork and having an internally threaded hole extending along the longitudinal axis from said first end, and an anchor portion engaged with a part of said internally threaded hole formed in said connection member and extending along the longitudinal axis from a second end, opposite said first end; and wherein said steel formwork has an opening therethrough, adjacent to which said internally threaded hole of said connection member is provided, and wherein said removable tightening apparatuses are inserted from above said steel formwork through said opening and are fixed in a remainder of said internally threaded hole of said connection member.

15. The method for constructing a building according to claim 14, wherein said composite integrated module includes a groundwork and other equipment, said groundwork having an upper end positioned above a surface of concrete poured on said frames is provided on said frame, and said other equipment is mounted on said groundwork.

16. The method for constructing a building according to claim 14, wherein said internally threaded hole extends through said connection member from said first end to said second end, and wherein said anchor portion includes an external threaded portion fixed in said internally threaded hole of said connection member.

17. A method for constructing a building, comprising the steps of:

transferring a composite integrated module comprising a floor member, a plurality of sidewall members installed on said floor member, and a ceiling member installed on said sidewall members;

wherein said floor member, said sidewall members, and said ceiling member are connected to each other form an internal space, said floor member has a first steel formwork facing said internal space, each of said sidewall members respectively has a second steel formwork facing said internal space, the ceiling member has a third steel formwork facing said internal space, anchor members are mounted on the outer side of at least one of said first steel formwork, said second steel formwork and said third steel formwork so as not to project into said internal space, and a structure disposed in said internal space mounted to said at least one of said first steel formwork, said second steel formwork and said third steel formwork with said anchor members by connecting removable tightening apparatuses to said anchor members from said internal space;

placing said composite integrated module on a predetermined construction site of the building; and pouring concrete outside said first steel formwork, said second steel formwork and said third steel formwork of said placed composite integrated module;

wherein each of said anchor members comprises a longitudinally extending connection member having a longitudinal axis perpendicular to said at least one of said first steel formwork, said second steel formwork and said third steel formwork, a first end of said connection member being fixed to said outer side of said at least one of said first steel formwork, said second steel formwork and said third steel formwork, and having an internally threaded hole extending along the longitudinal axis from said first end, and an anchor portion engaged with a part of said internally threaded hole formed in said connection member and extending along the longitudinal axis from a second end, opposite said first end; and wherein said at least one of said first steel formwork, said second steel formwork and said third steel formwork has an opening therethrough, adjacent to which said internally threaded hole of said connection member is provided, and wherein said removable tightening apparatuses are inserted from said internal space through said opening and are fixed in a remainder of said internally threaded hole of said connection member.

18. The method for constructing a building according to claim 17, wherein said floor member has first frame beam mounted outside said first steel formwork, said sidewall members have a plurality of frame columns mounted outside said second steel formwork, a lower end portion of each frame column is mounted on said first frame beam, and an upper end portion of each frame column is mounted to said ceiling member.

19. The method for constructing a building according to claim 18, wherein said ceiling member has second frame beams including an opening through which concrete is poured, said third steel formwork is mounted on said second frame beam, and said second frame beam is connected to an upper end portion of said frame column.

20. The method for constructing a building according to claim 19, wherein an upper end portion of said second steel formwork is mounted on said second frame beam.

21. The method for constructing a building according to claim 17, wherein said internally threaded hole extends through said connection member from said first end to said second end, and wherein said anchor portion includes an external threaded portion fixed in said internally threaded hole of said connection member.

22. A method for constructing a building, comprising the steps of:

transferring a composite integrated module comprising a floor member, a plurality of sidewall members installed on said floor member, and a ceiling member installed on said sidewall members;

wherein said floor member, said sidewall members, and said ceiling member connected to each other form an internal space, said floor member has a first steel formwork facing said internal space, and a plurality of frame beams mounted on an undersurface of said first steel formwork, mounted on lower end portions of said sidewall members, and buried in concrete, said sidewall members respectively have a second steel formwork facing said internal space, said ceiling member has a third steel formwork facing said internal space, anchor members are mounted on an outer side of at least one of said first steel formwork, said second steel formwork and said third steel formwork so as not to project into said internal space, a structure disposed in said internal space mounted to said at least one of said first steel formwork, said second steel formwork and said third steel formwork with said anchor members by connecting removable tightening apparatuses to said anchor members from said internal space, a groundwork having an upper end positioned above a surface of concrete poured on said frames is provided on said frame, and other equipment arranged in said internal space is mounted on said groundwork;

placing said composite integrated module on a predetermined construction site of the building;

pouring concrete between said frame beams, and outside said second steel formwork and said third steel formwork of said placed composite integrated module; and pouring concrete above said frame beam so that a slanted surface of concrete inclines towards a set direction and said groundwork is projected from said slanted surface;

wherein each of said anchor members comprises a longitudinally extending connection member having a longitudinal axis perpendicular to said at least one of said first steel formwork, said second steel formwork and said third steel formwork, a first end of said connection member being fixed to said outer side of said at least one of said first steel formwork, said second steel formwork and said third steel formwork, and having an internally threaded hole extending along the longitudinal axis from said first end, and an anchor portion engaged with a part of said internally threaded hole formed in said connection member and extending along the longitudinal axis from a second end, opposite said first end; and wherein said at least one of said first steel formwork, said second steel formwork and said third steel formwork has an opening therethrough, adjacent to which said internally threaded hole of said connection member is provided, and wherein said removable tightening apparatuses are inserted from said internal space through said opening and are fixed in a remainder of said internally threaded hole of said connection member.

23. The method for constructing a building according to claim 22, wherein said internally threaded hole extends through said connection member from said first end to said second end, and wherein said anchor portion includes an external threaded portion fixed in said internally threaded hole of said connection member.

* * * * *